US006835026B2

(12) United States Patent
Gjedebo

(10) Patent No.: US 6,835,026 B2
(45) Date of Patent: Dec. 28, 2004

(54) RISER TENSIONING ARRANGEMENT

(75) Inventor: Jon G. Gjedebo, Stavanger (NO)

(73) Assignee: National Oilwell Norway AS, Stavanger (NO)

( * ) Notice: Subject to any disclaimer, the term of this patent is extended or adjusted under 35 U.S.C. 154(b) by 0 days.

(21) Appl. No.: 10/476,124

(22) PCT Filed: Apr. 23, 2002

(86) PCT No.: PCT/NO02/00153

§ 371 (c)(1),
(2), (4) Date: Mar. 29, 2004

(87) PCT Pub. No.: WO02/088512

PCT Pub. Date: Nov. 7, 2002

(65) Prior Publication Data

US 2004/0146363 A1 Jul. 29, 2004

(30) Foreign Application Priority Data

Apr. 27, 2001 (NO) ..... 20012078

(51) Int. Cl.[7] ..... E21B 19/09
(52) U.S. Cl. ..... 405/224.4; 405/224.2
(58) Field of Search ..... 405/224.4, 224.3, 405/224.2

(56) References Cited

U.S. PATENT DOCUMENTS

| | | | | |
|---|---|---|---|---|
| 3,211,224 | A | 9/1963 | Lacy | |
| 3,643,751 | A | 2/1972 | Crickmer | |
| 4,657,439 | A | 4/1987 | Petersen | |
| 6,402,430 | B1 * | 6/2002 | Guesnon | 405/224.2 |

FOREIGN PATENT DOCUMENTS

| | | |
|---|---|---|
| NO | 302493 | 3/1998 |
| NO | 308379 | 9/2000 |

* cited by examiner

*Primary Examiner*—Frederick L. Lagman
(74) *Attorney, Agent, or Firm*—Andrus, Sceales, Starke & Sawall, LLP

(57) ABSTRACT

An arrangement for transferring loads by means of one or more hydraulic cylinder-like actuators (19, 26, 40) in order to establish and maintain tension in a riser (1) of the type typically used in offshore petroleum production, where the riser (1) constitutes a connection between the sea bed (2) and an installation (4) on or near the surface of the sea (6), and where the required pressure difference between the pressure side(s) (18, 42) and the depressurised side(s) (17, 46) of the actuator(s) (19, 29, 40) is constituted by a hydrostatic pressure difference.

6 Claims, 3 Drawing Sheets

RISER TENSIONING ARRANGEMENT

CROSS REFERENCE TO RELATED APPLICATION

The present application is the U.S. national stage application of International Application PCT/NO02/00153, filed Apr. 23, 2002, which international application was published on Nov. 7, 2002 as International Publication WO 02/088512. The International Application claims priority of Norwegian Patent Application 20012078, filed Apr. 27, 2001.

FIELD OF THE INVENTION

This invention regards an arrangement for establishing and maintaining tension in a riser of the type typically used for offshore petroleum production, where the riser constitutes a connection between the seabed and an installation on the surface of the sea.

BACKGROUND OF THE INVENTION

When establishing a petroleum well offshore by means of a drilling vessel, it is normal to set in place a riser extending between the seabed and the drilling vessel, relatively early in the drilling phase. Besides being used for controlling drill tools, the riser is also used for carrying drill fluid between the well and the drilling vessel.

A riser is ordinarily formed as a length of tubing telescopically connected to the drilling vessel, where the lower portion of the riser is connected to seabed equipment. The dimensions and weight of the riser are considerable, and it is crucial to the function of the riser that tension be established and maintained in the riser, to ensure that the riser is subjected to insignificant compressive stresses only. If the riser is subjected to the load of its own mass, which may typically amount to several hundred tons, it will automatically break.

In order to establish and maintain sufficient tension in the riser, compensating means are normally connected between the drilling vessel and the upper portion of the riser. The compensating means typically comprise one or more hydraulic cylinders, where the pressure side of the cylinders are in communication with a hydraulic pump and hydraulic accumulators through associated pipes and a system of valves.

The heave motion of the drilling vessel and changes in the sea level are taken up by the telescope connection between the drilling vessel and the riser. The compensating means must be constructed so as maintain more or less constant tension in the riser, also during said motion, and the accumulators of the compensating means are therefore designed to receive and deliver the largest share of the pressure fluid that must be drained and supplied to the compensating cylinders during the motion of the drilling vessel.

It is obvious that hydraulic pumping and accumulator systems of the type referred to here are both very extensive and complicated, while also being costly both to procure, install and operate. Moreover, there is a danger that any interruption of power to the pumping system may after a while entail a risk of insufficient supply of pressure fluid to the hydraulic compensating cylinders, whereby the riser may be damaged.

The object of the invention is to remedy the disadvantages of prior art.

SUMMARY OF THE INVENTION

The object is achieved in accordance with the invention by the characteristics stated in the description below and in the appended claims.

In a heave compensating means according to the invention, the required pressure difference between the two fluids acting on the two piston sides of the compensating cylinders is effected by means of the hydrostatic pressure that exists under the surface of the sea.

In one embodiment in which the compensating cylinders are located by the surface of the sea, a bell in the form of a receptacle is arranged in the sea at a predetermined depth below the surface. The bell has an opening in its lower portion, where water may flow in and out. At its upper portion, the bell is connected in a communicating manner to the pressure side of the compensating cylinder by means of an interconnecting pipe/hose/conduit. Said interconnecting pipe is also connected to a compressor or other pressure source designed to supply the bell with air or another fluid having a significantly lower density than water.

By introducing such relatively light fluid to the pipe and the pressure bell, a fluid pressure is established, at the surface in the interconnecting pipe and the pressure sides of the compensating cylinders, which corresponds to the hydrostatic pressure difference in the water outside the bell and in the fluid in the bell.

In another embodiment, in which the telescopic section of the riser and the compensating cylinders are located at a considerable depth below the surface of the sea, the pressure sides of the cylinders are supplied with seawater through an opening in the cylinders, or with another fluid through an interconnecting pipe to the surface. The depressurised sides of the cylinders are connected to the surface via an interconnecting pipe that is under vacuum or filled with a relatively light fluid.

The operation of the arrangement is explained in greater detail in the specific part of the description with reference to the appended drawings.

An advancement of the invention may be to provide a separating tank/cylinder in the fluid supply for the cylinder, designed to supply the cylinder with a fluid that is different from the pressure fluid.

BRIEF DESCRIPTION OF THE DRAWINGS

The following describes a non-limiting example of a preferred embodiment illustrated in the accompanying drawings, in which.

DETAILED DESCRIPTION OF THE INVENTION

Figure 1:
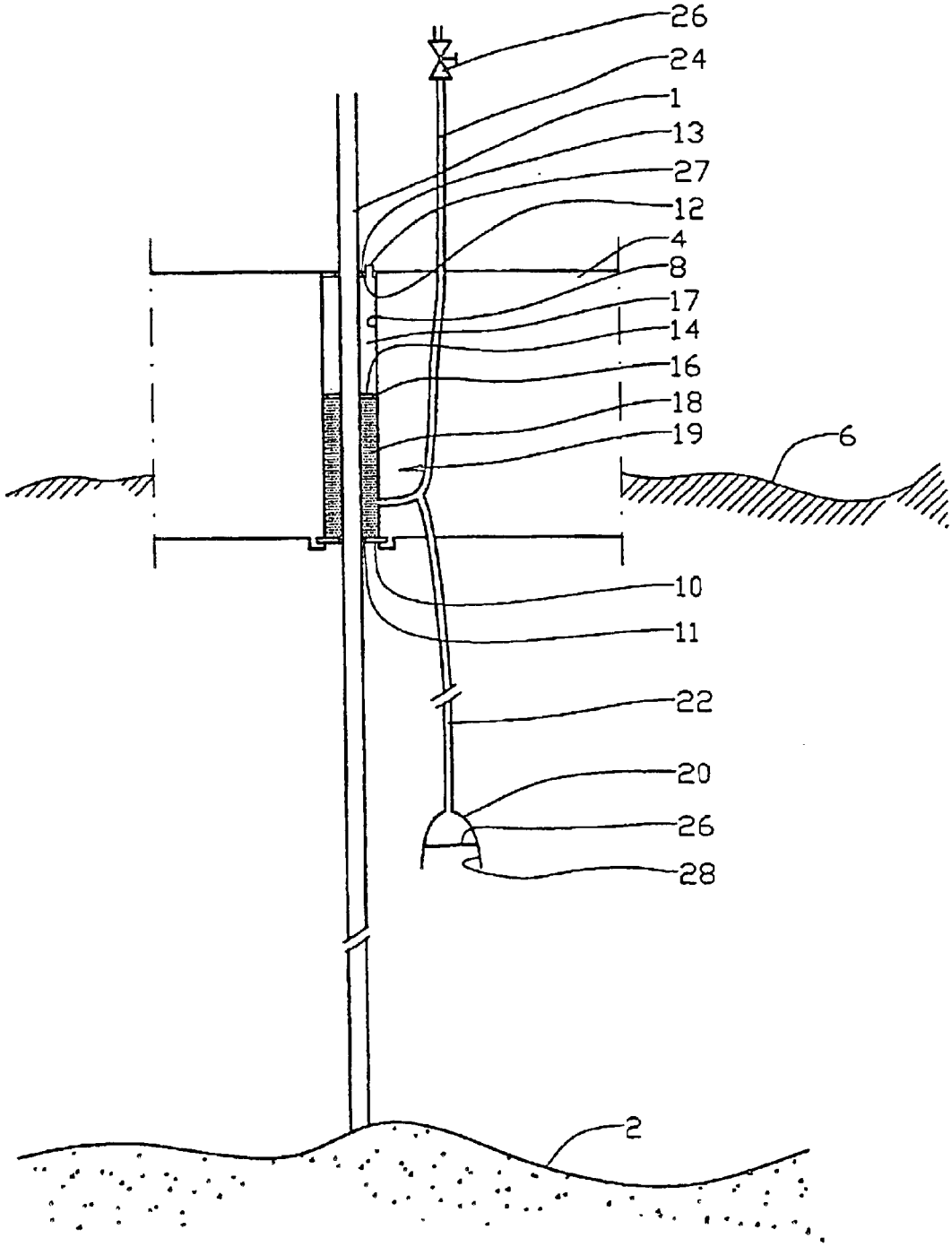
FIG. 1 schematically shows a floating installation where the hydrostatic pressure of the sea is utilised to pressurise a hydraulic cylinder-like actuator formed by the through bore of the installation forming a cylinder casing and the riser forming the piston rod of the cylinder.

In the drawings, reference number 1 denotes a riser of a type that is known per se, which is anchored to the seabed 2. The riser 1 rises up to a normally floating installation 4 located on the surface 6. In a preferred embodiment, see FIG. 1, the floating installation 4 is made up of a buoy equipped with a through bore 8, and where a gable plate 10 is sealingly connected to the lower portion of the bore 8. The gable plate 10 is equipped with a packing 11 that movably seals against the external tubular surface of the riser 1. The bore 8 may be provided with a similar gable plate 12 and packing 13 at its upper end portion. The riser 1, in a position slightly above the gable plate 10, is equipped with a piston 14 that movably seals against the bore 8 with the aid of a packing 16.

The bore 8, gables 10, 12, the piston 14 and the riser 1 form a hydraulic cylinder-like actuator 19, in which the cylinder volume between the piston 14 and the gable 10 constitutes the pressure side 18 of the cylinder 19, while the cylinder volume between the piston 14 and the gable 12 constitutes the depressurised side 17 of the cylinder.

The pressure side 18 of the cylinder 19 is connected via a pipe/hose/conduit 22 to a bell 20 located at a considerable distance below the surface of the sea 6. A pipe 24 is connected to a shut-off valve 26 and joined to the pipe 22. The depressurised side 17 of the cylinder 19 is connected to atmosphere via an opening 27.

When the load of the riser 1 is to be taken up by the buoy 4, a fluid that is considerably lighter than water is pumped in through the valve 26 and the pipes 22 and 24 to the cylinder chamber 18 and the bell 20. When a sufficient amount of fluid has been pumped in, a surface 26 forms in the bell 20, the lower portion of which bell has an opening 28. The valve 26 is then closed. The fluid pressure in the pipe 22 at the surface 6 corresponds to the hydrostatic pressure difference in the water outside the bell 20 and in the fluid in the bell and the pipe 22. The surface area of the piston 14 is adjusted so as to transfer the required tensile force to the riser 1.

When the buoy 4 rises, the volume on the pressure side 18 is reduced, whereby fluid flows out of the cylinder 19 and down through the pipe 22 to the bell 20. The surface 26 in the bell 20 only falls slightly, due to the large cross sectional area of the bell 20 relative to that of the piston 14. When the buoy 4 sinks, pressure fluid flows back to the pressure side 18 of the cylinder 19, thus maintaining a substantially constant force in the riser 1.

Figure 2:
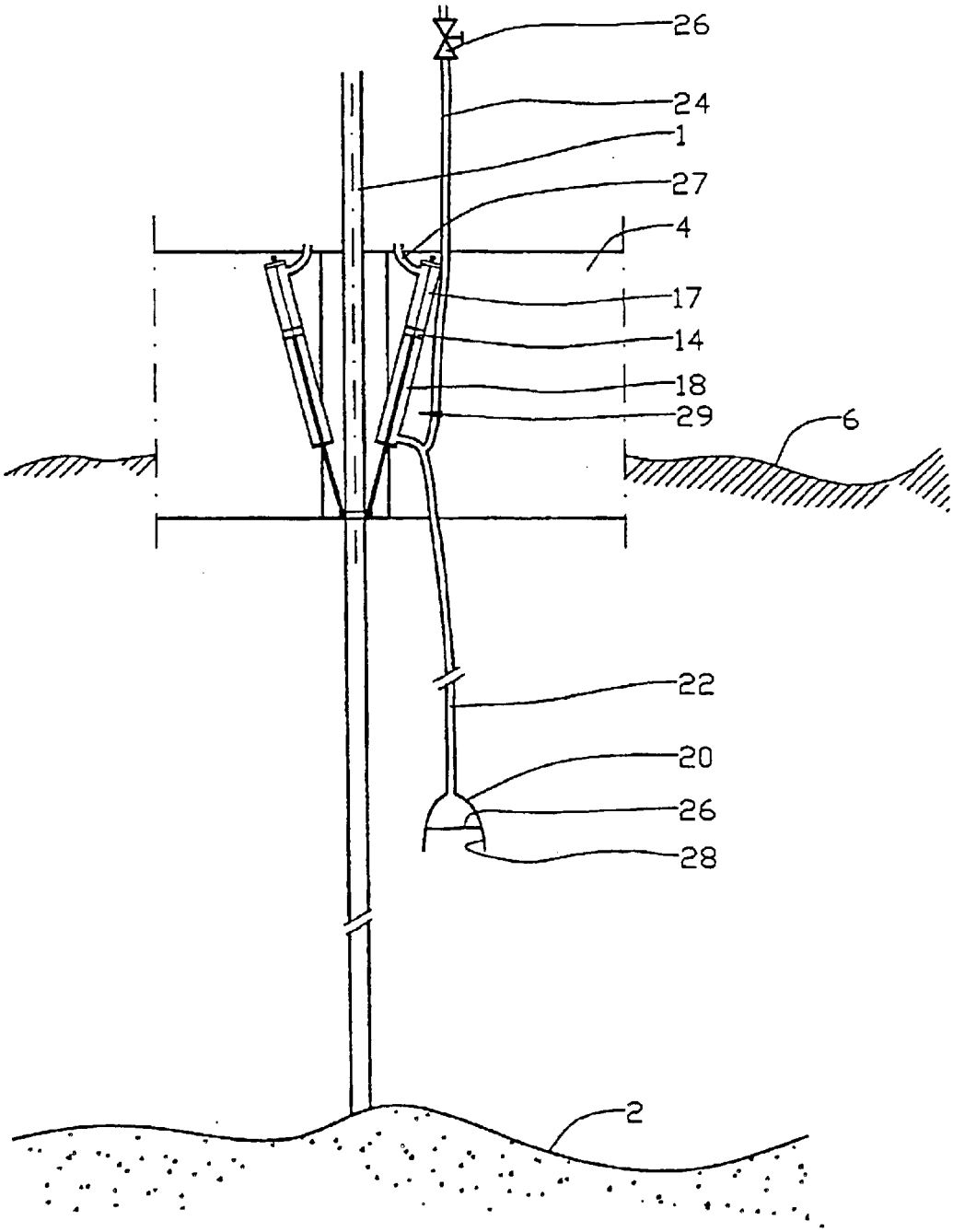
FIG. 2 shows the same as FIG. 1, but here the floating installation is equipped with compensating cylinders of a conventional type.

The invention is equally suited when using conventional compensating cylinders 29 between the floating installation 4 and the riser 1, see FIG. 2.

Figure 3:
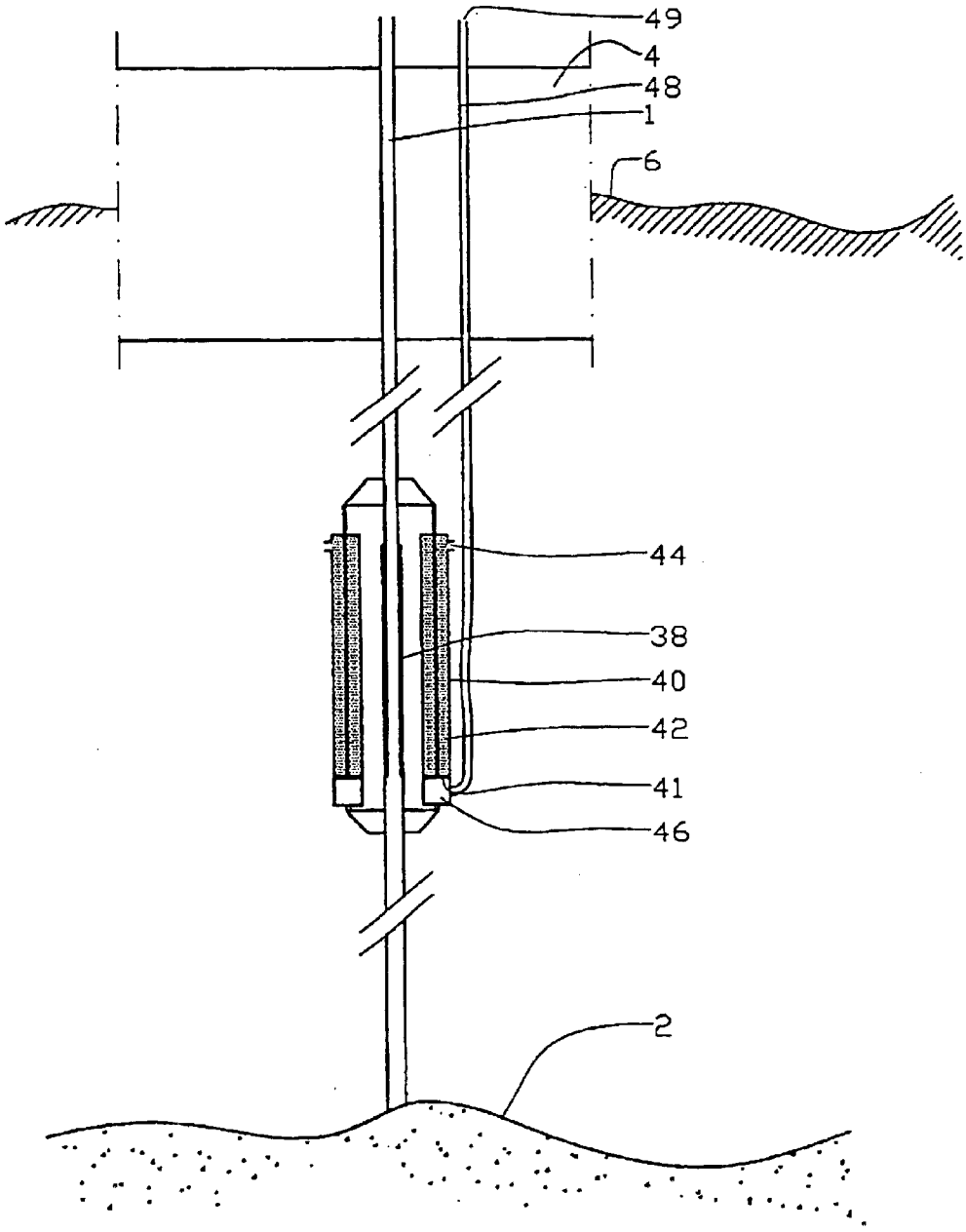
FIG. 3 schematically shows an installation where the telescopic connection of the riser is arranged at a considerable depth below the surface of the sea, and where several hydraulic cylinders extend between and are connected to the upper and lower portions of the riser.

In another embodiment, the telescope section 38 of the riser 1 is located at a considerable depth below the surface of the sea 6, see FIG. 3. One or more compensating cylinders 40 of a type that is known per se, but which are adapted to subsea use, are connected to the riser 1 above and below the telescope section 38 and designed to establish and maintain a tensile force in the riser 1. The pressure sides 42 of the compensating cylinders 40, located on one side of the pistons 41 of the cylinders 40, communicate with the seawater on the outside of the cylinders 40 through openings 44, while the depressurised sides 46 of the cylinders 40 communicate with the atmosphere by means of a pipe 48 and opening 49.

The pipe 48 is filled with a fluid that is significantly lighter than water. Alternatively, the pipe is under vacuum. The operation of the compensating cylinder 40 during the vertical movements of the floating installation is analogous to that described above.

The arrangement according to the invention allows a major simplification of the heave compensating means of a floating installation 1, the utilisation of the sea's own hydrostatic pressure essentially making known pumping and accumulator systems superfluous. Thus a reduction in operating costs and improved operational reliability may be expected when using the new technique.

What is claimed is:

1. An arrangement for transferring loads by means of one or more hydraulic cylinder-like actuators (19, 26, 40) in order to establish and maintain tension in a riser (1) of the type typically used in offshore petroleum production, where the riser (1) constitutes a connection between the sea bed (2) and an installation (4) on or near the surface of the sea (6), and where the required pressure difference between the pressure side(s) (18, 42) and the depressurised side(s) (17, 46) of the actuator(s) (19, 29, 40) is constituted by a hydrostatic pressure difference, characterised in that the pressure side(s) (18) of the actuator(s) (19, 29) is/are communicatingly connected with the seawater, directly or indirectly, via a pipe connection (22), an opening (28) being located at a considerable depth below the surface of the sea (6), and where the pipe connection (22) is substantially filled with a fluid with a lower density than that of water.

2. An arrangement in accordance with claim 1, characterised in that the depressurised side(s) (17) of the actuator(s) (19, 29) is/are communicatingly connected with the atmosphere through an opening (27).

3. An arrangement in accordance with claim 1, characterised in that the depressurised side(s) (17, 46) of the actuator(s) (19, 29, 40) is/are closed and under vacuum.

4. An arrangement in accordance with claim 1, characterised in that the pipe connection (22) communicates with the seawater via a bell (20).

5. An arrangement for transferring loads by means of one or more hydraulic cylinder-like actuators (19, 26, 40) in order to establish and maintain tension in a riser (1) of the type typically used in offshore petroleum production, where the riser (1) constitutes a connection between the sea bed (2) and an installation (4) on or near the surface of the sea (6), and where the pressure sides (42) of the actuators (40) are communicatingly connected with the seawater, directly or indirectly, via an opening (44), where the opening (44) is located at a considerable depth below the surface of the sea (6), characterised in that the depressurised sides (46) of the actuators (40) are communicatingly connected with the atmosphere via a pipe connection (48) and through an opening (27), and where the pipe connection (22) is substantially filled with a fluid with a lower density than that of water.

6. An arrangement in accordance with claim 5, characterised in that the depressurised side(s) (46) of the actuator(s) (40) is/are closed and under vacuum.

* * * * *